US007900750B2

(12) United States Patent
Mattsson et al.

(10) Patent No.: US 7,900,750 B2
(45) Date of Patent: Mar. 8, 2011

(54) ELEVATOR SYSTEM

(75) Inventors: Veikko Mattsson, Hyvinkää (FI); Marja-Liisa Siikonen, Helsinki (FI); Kari Suihkonen, Hyvinkää (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 12/786,222

(22) Filed: May 24, 2010

(65) Prior Publication Data

US 2010/0270110 A1 Oct. 28, 2010

Related U.S. Application Data

(63) Continuation of application No. PCT/FI2008/000130, filed on Nov. 21, 2008.

(30) Foreign Application Priority Data

Nov. 26, 2007 (FI) ..... 20070903

(51) Int. Cl.
*B66B 1/28* (2006.01)

(52) U.S. Cl. ..... 187/247; 187/382

(58) Field of Classification Search ..... 187/247–249, 187/380–388, 391–393
See application file for complete search history.

(56) References Cited

U.S. PATENT DOCUMENTS

| | | | | |
|---|---|---|---|---|
| 4,844,204 | A * | 7/1989 | Ovaska et al. | 187/247 |
| 5,352,857 | A * | 10/1994 | Ovaska | 187/247 |
| 5,389,748 | A * | 2/1995 | Burke et al. | 187/247 |
| 6,892,861 | B2 * | 5/2005 | Friedli | 187/247 |
| 6,935,465 | B2 * | 8/2005 | Friedli | 187/247 |
| 7,360,629 | B2 * | 4/2008 | Hagi et al. | 187/249 |
| 2003/0121728 | A1 | 7/2003 | Friedli | |
| 2005/0217946 | A1 | 10/2005 | Siikonen et al. | |
| 2008/0149432 | A1 * | 6/2008 | Friedli et al. | 187/382 |

FOREIGN PATENT DOCUMENTS

| | | | |
|---|---|---|---|
| EP | 0 523 601 | A1 | 1/1993 |
| EP | 523601 | A1 * | 1/1993 |
| EP | 0 631 965 | A1 | 1/1995 |
| GB | 2 156 104 | A | 10/1985 |
| GB | 2 274 001 | A | 7/1994 |
| JP | 8-18767 | B2 | 2/1996 |
| JP | 2001-19288 | A | 1/2001 |
| WO | WO 2007/036597 | A2 | 4/2007 |

* cited by examiner

*Primary Examiner* — Jonathan Salata
(74) *Attorney, Agent, or Firm* — Birch, Stewart, Kolasch & Birch, LLP

(57) ABSTRACT

The present invention discloses a method and a system for modernizing at least one elevator group, which comprises a plurality of elevators, a group control that controls the elevator group as well as call-giving appliances connected to the group control via the landing appliance bus. According to the solution a new group control, new call-giving appliances for the floor levels and also a new landing call bus are installed in the elevator group; a new group control is connected to the pushbutton interface of the old call-giving appliances for transmitting calls given by passengers from the new group control to the old group control. The elevator calls given by passengers are divided between the modernized subgroup and at least one unmodernized subgroup on the basis of the given selection criterion, and a call addressed to the modernized subgroup is allocated in the new group control to the modernized elevators or a call addressed to the unmodernized subgroup is transmitted via the pushbutton interface to the unmodernized subgroup.

21 Claims, 3 Drawing Sheets

ELEVATOR SYSTEM

CROSS REFERENCE TO RELATED APPLICATIONS

This application is a Continuation of PCT International Application No. PCT/FI2008/000130 filed on Nov. 21, 2008, which claims the benefit of Patent Application No. 20070903 filed in Finland, on Nov. 26, 2007. The entire contents of all of the above applications is hereby incorporated by reference into the present application.

FIELD OF THE INVENTION

The invention relates to elevator systems. More particularly the invention relates to a method and to a system for modernizing an elevator group.

BACKGROUND OF THE INVENTION

High-rise buildings typically contain a number of elevators, escalators and other corresponding traveling means for transporting people from one floor to another in the building. When a passenger gives calls to the elevators, the group control of the elevator system allocates an elevator in the elevator system to the passenger's use on the basis of the prevailing traffic situation and the given optimization criteria. The giving of calls in a conventional elevator system is arranged by disposing up/down pushbuttons on each floor, by means of which the passenger expresses his/her desired direction of travel and further, after the elevator has reached the floor on which the passenger is located, the passenger expresses his/her desired destination floor by means of the destination floor pushbuttons in the elevator car. The method of giving calls described above is, however, impractical and often inefficient, as a result of which the giving of calls in elevator systems is implemented to an increasing extent by means of a so-called destination call system, in which the passenger gives his/her personal destination floor information already at the departure floor, e.g. in the entrance lobby before going into the elevator car. The giving of a destination call takes place by means of a special destination call terminal, either with pushbuttons and/or by means of an electrically readable identifier, e.g. an RFID (radio frequency identifier) tag. Since in connection with a destination call the departure point and terminal point of the travel route of each passenger is identified and therefore available to the group control, the group control is able to determine the travel route of a passenger precisely and optimally compared to a conventional call-giving system.

The objective of allocating calls given by passengers is to assess the different route options for passengers and to give the calls to be served to the elevators in such a way that some performance indicator or a combination of performance indicators describing the elevator system is as good as possible. Conventionally the most commonly used performance indicators are performance indicators relating to the service times of a passenger but optimization criteria relating to energy or to another corresponding property of the elevator system are also possible. A so-called cost function is generally used to compare route options with each other, the minimization of the value (total cost) of which cost function with different route options expresses the optimal allocation. The allocation can also be implemented such that a suitable cost function for the best traffic situation at that time is taken into use in different traffic situations. This is to give the elevator system the opportunity to adapt to the prevailing traffic situation, e.g.

upward peak traffic in a building. The technique in question is described in patent publication FI972937, among others, from where a control method of an elevator group is known in which the control of the elevators is optimized on the basis of the traffic situation, i.e. the traffic type and the traffic intensity prevailing at any given time, in which case the prevailing traffic situation is identified and the elevator group is controlled on the basis of the optimization criteria corresponding to the aforementioned traffic situation. In order to identify the prevailing traffic situation, statistical information is collected about the use of the elevator system according to different 24-hour periods and days of the week, and the future traffic situation of the elevator system is forecast at any given moment in time on the basis of the statistical data collected. The solution in question is called a traffic forecaster.

The elevator systems of buildings are typically long-term investments, which from time to time must be modernized in situations in which they no longer meet the requirements set for the traffic arrangements of the building. The reason for modernization can be e.g. a substantial increase in maintenance costs owing to the obsolescent elevator technology of the elevator systems, or it is possible that the usage of the building has changed and the transport capacity of the elevator systems is not sufficient for transporting the increased number of passengers in the building. It is also usual that changes occurring in the safety aspects and/or in the official regulations of the elevator systems influence modernization decisions.

Modernization projects are by nature demanding projects, which can last months, in certain cases even years, if the entire installed base of elevators of the building must be modernized. Owing to this an essential objective attached to the modernization of elevator systems is maintaining the transport capacity of the elevator systems during the modernization phase. So that the transport capacity is disturbed as little as possible during the modernization, it is attempted to implement the modernization in stages, e.g. by modernizing one elevator of the elevator group at a time in each stage. During modernization it is therefore typical that some of the elevators of an elevator group are modernized and some are unmodernized, with the shared use of which the elevator passengers must be served. For the coordination and shared use of the modernized and unmodernized elevators to be efficient, in some prior-art modernization solutions the group control of an elevator group is replaced with a new group control immediately in the initial stage of the modernization work. The new group control is connected in this case to the elevator controls that are to be modernized by means of special adapter units such that the calls given by passengers can be allocated in the new group control to both unmodernized and modernized elevators and the control commands according to the allocation result can be transmitted to each elevator via the aforementioned adapter units. One such prior-art modernization solution is presented in Finnish patent publication FI98362, in which a new group control as well as new elevator-specific elevator controls are temporarily connected to the old elevator controls by means of special adapter units. The elevator group is modernized by function modules by integrating the functionalities and/or the function modules to be modernized into a new group control and/or into new elevator controls and by removing the corresponding functions from the old elevator controls until all the modernization procedures are done and the temporary adapter units as well as the old elevator controls can be removed from the elevator group. Another prior-art solution is disclosed in publication U.S. Pat. No. 6,935,465, in which the aforementioned destination call system is utilized in connection with modernization. In the solution in question in the starting stage of the modernization work the old elevator controls in the elevator group are connected using special adapter units to the new group control and also destination call panels are installed on the floor levels for receiving destination calls given by passengers. The new group control allocates elevators from the elevator group on the basis of destination calls given by the passengers and if an elevator allocated to a passenger is an unmodernized elevator, the new group control transmits control commands according to the destination call via the aforementioned adapter unit to the old elevator control of the allocated elevator. One prior-art modernization solution is also presented in publication U.S. Pat. No. 5,389,748, in which a new group control as well as a special adapter computer (ITM) is connected to the elevator system to be modernized, wherein the landing calls given by passengers are divided to the old group control and to the new group control in the desired ratio. In the solution in question the old landing appliance bus together with the landing call appliances are removed and replaced with new landing call appliances and also a new landing appliance bus, which is connected to the aforementioned adapter computer. To transmit the landing calls to the group controls, the adapter computer is connected to an interface of the landing appliance bus of both the new and the old group control.

One problem with prior-art modernization solutions is that when replacing an old group control of an elevator group with a new group control it is necessary during the initial stage of the modernization to arrange interfaces (a so-called overlay) between the new group control and the old elevator controls. If the interface in question must be arranged in all the old elevator controls, the interface easily becomes complex and laborious to implement. Particularly in large elevator groups, the number of circuits needed can rise to be very high because the more elevators there are in the elevator group to be modernized the greater the number of connection points there are. As the number of circuits during the modernization increases, the costs of the modernization work as well as the probability of wrong connections rise, in which case the implementation becomes error-prone and the operating safety of the elevators can be jeopardized during the modernization. Often also it is necessary to tailor one-time functionalities for the adapter units and/or for the other systems required by the modernization, which functionalities are individual to the elevators of a certain manufacturer thereby, of course, increasing the modernization costs. In elevator systems in which signals between the group control and the elevator-specific controls or the landing appliances are transmitted through a manufacturer-specific data transfer protocol in serial format, the implementation of prior-art modernization solutions can be extremely laborious if not almost impossible. Special drives can also be connected to elevator systems that are to be modernized, e.g. fireman's drive, the implementation of which during modernization is typically awkward and can demand special arrangements during the modernization in order for e.g. a fireman's drive that is compliant with official regulations to be implemented and maintained in the elevator system to be modernized.

PURPOSE OF THE INVENTION

The purpose of the present invention is to eliminate or at least to alleviate the aforementioned drawbacks that occur in prior-art modernization solutions. The purpose of the invention is also to achieve one or more of the following objectives:

- to improve the operating safety of the elevator system during modernization,
- to offer a modernization solution which is easily applied to the modernization of elevator systems implemented by different elevator manufacturers,
- to offer a solution in which thee is no need to transmit elevator-specific signals from the control of the elevators to be modernized to a new group control,
- to minimize the need for interfaces during a modernization,
- to offer a modernization solution in which the number of interfaces during the modernization does not depend on the number of elevators to be modernized, and in which the interfaces required by the modernization can be implemented using simple binary signals,
- to enable the modernization of two or more elevator groups and their integration into a single elevator group,
- to offer a modernization solution in which the old landing call appliances can be replaced with destination call appliances.

SUMMARY OF THE INVENTION

The method according to the invention is characterized by what is disclosed in the characterization part of claim 1. The system according to the invention is characterized by what is disclosed in the characterization part of claim 12. Other embodiments of the invention are characterized by what is disclosed in the other claims. Some inventive embodiments are also presented in the drawings in the descriptive section of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. The features of the various embodiments can be applied within the scope of the basic inventive concept in conjunction with other embodiments.

In the following the meaning of certain terms used in this context is explained in more detail:

- traffic situation: determines the traffic type as well as the traffic intensity prevailing in the elevator system, e.g. "light mixed traffic". The traffic type indicates the direction of the passenger flows generally prevailing in the elevator system, e.g. upward traffic (from the entrance lobby to the other floors of the building), downward traffic (from the other floors of the building to the entrance lobby), internal traffic (traffic between floors, in which the passenger does not arrive in the building or leave the building), two-way traffic (simultaneous downward traffic and upward traffic), mixed traffic (a combination of different traffic types). The traffic intensity indicates how heavy the traffic prevailing in the elevator system is in relation to the maximum transport capacity of the elevator system, e.g. light traffic, normal traffic, heavy traffic and intensive traffic. In addition to the above, many other categorizations of traffic types and traffic intensities are possible.
- elevator type: the term refers to either a modernized elevator or to an unmodernized elevator.
- subgroup: the term refers to a subgroup formed of modernized elevators or unmodernized elevators, which is controlled with its own group control.

The present invention discloses a method for modernizing at least one elevator group, which comprises a plurality of elevators, a group control that controls the elevator group as well as call-giving appliances connected to the group control via the landing appliance bus, each call-giving appliance comprising one or more call pushbuttons. The method according to the invention comprises the phases: a new group control, new call-giving appliances for the floor levels and also a new landing call bus for connecting the aforementioned new call-giving appliances to the new group control are installed in the elevator group; the new group control is connected to the pushbutton interface of the old call-giving appliances for transmitting calls given by passengers from the new group control to the old group control; one or more elevators of the elevator group are modernized; the elevator calls given by passengers are divided between the modernized subgroup and at least one unmodernized subgroup on the basis of the given selection criterion; the calls addressed to the modernized subgroup are allocated in the new group control to the modernized elevators; and the calls addressed to the unmodernized subgroup are transmitted via the pushbutton interface to the group control of the unmodernized subgroup.

The present invention also discloses a system for modernizing at least one elevator group, which comprises a plurality of elevators, a group control that controls the elevator group as well as call-giving appliances connected to the group control via the landing appliance bus, each call-giving appliance comprising one or more call pushbuttons, as well as a new group control installed at the beginning of the modernization, a new landing appliance bus with call-giving appliances and also one or more modernized elevators. According to the invention the system is connected to the pushbutton interface for transmitting calls from the new group control to the old group control. The new group control is arranged to divide elevator calls given by passengers with the new call-giving appliances between the modernized subgroup and at least one unmodernized subgroup on the basis of the given selection criterion, and further to allocate the calls addressed to the modernized subgroup to the modernized elevators and to transmit calls addressed to the unmodernized subgroup via the pushbutton interface to the group control of the unmodernized subgroup.

In one embodiment of the invention the calls given by passengers are transmitted as landing calls to the group control of the unmodernized subgroup.

In one embodiment of the invention a destination call appliance is used as the call-giving appliance on one or more floors, and conventional landing call appliances are used on floors on which a destination call appliance is not installed. As a result of the embodiment the transport capacity of the elevator group can be increased already during the modernization by giving calls as destination calls and by efficiently dividing the calls given between the modernized and the unmodernized elevators.

In one embodiment of the invention the new group control is connected via the pushbutton interface to the pushbutton light signals of the old call-giving appliances for monitoring the on-state of calls transmitted to the old group control, on the basis of which it is possible to determine the waiting time of calls allocated to the unmodernized elevators. As a result of the embodiment the new group control can monitor the behavior and/or degree of congestion of the unmodernized elevators and utilize the information e.g. in selecting the subgroup that will serve a call.

In one embodiment of the invention adapter units are installed in the new landing appliance bus for connecting the new group control to the pushbutton interface of the old call-giving appliances on each floor level. As a result of the embodiment the interface between the old and the new group control can be implemented simply without the need for extra bus cabling to be installed in the elevator hoistway.

In one embodiment of the invention the new group control is connected via the new call-giving appliances to the pushbutton interface of the old call-giving appliances on each floor level. As a result of the embodiment the interface work is facilitated because temporarily installed adapter units are not needed but instead the interface needed is pre-integrated into the new call-giving appliances.

In one embodiment of the invention one or more classification rules are used as selection criterion/criteria, in which the calls given are divided between the modernized and the unmodernized subgroups either:

on the basis of average waiting time;
on the basis of one or more floor zones;
on the basis of the call history;
on the basis of one or more pre-determined standard floors;
on the basis of a call-specific waiting time;
on the basis of the load factor of the elevators;
on the basis of the traffic intensity;
on the basis of the traffic type;
in relation to the number of modernized and unmodernized elevators;
on the basis of additional information attached to the call;

As a result of the embodiment the division of calls can be optimized for the specific building and elevator system in order to achieve the desired service targets.

In one embodiment of the invention the classification rules and/or the threshold values of the classification rules are selected on the basis of the modernization extent of the elevator group and/or the traffic situation and/or the exceptional situation of the elevator system manually and/or automatically. As a result of the embodiment the selection criterion can be dynamically changed according to the traffic situation prevailing in the elevator system at any time and thus the transport capacity of the elevator system and/or another desired property of the elevator system can be optimized to best meet the prevailing traffic situation. As a result of the embodiment the behavior of the elevator system can be optimized also in exceptional circumstances e.g. when one or more elevators of the elevator system are out of use or when evacuating the building e.g. owing to a fire detected in the building.

In one embodiment of the invention statistical data about the travel events of the elevator system are collected, which statistical data is utilized in determining the traffic situation prevailing in the elevator system and/or in determining the floor-specific traffic intensities of the elevator system. As a result of the embodiment it is possible to make estimates more accurately than before of the traffic situation prevailing in the elevator system at any time and generally of the traffic flows of the building.

In one embodiment of the invention a number of elevator groups are modernized to become a single elevator group. In the embodiment the new group control is connected to the group control of two or more elevator groups that are to be modernized by connecting it to the pushbutton interface of the call-giving appliances of the elevator groups that are to be modernized for transmitting calls from the new group control to the group controls of the elevator groups that are to be modernized. With the embodiment it is possible to modernize two or more elevator groups into one elevator group, in which case the allocation of calls, among other things, can be made more efficiently in the new elevator group compared to the allocation of calls of a number of elevator groups that are independent of each other.

Owing to the present invention the operating safety of the elevator system can be improved during the modernization, because the number of interfaces required by the modernization can be minimized, and there is no need to transmit signals from the control of the elevators to be modernized to the new group control. The interfaces needed can be implemented using simple binary signals. The solution according to the invention is preferably applicable to the modernization of the elevators of different elevator manufacturers, in connection with which also the old landing call appliances can be replaced with more efficient destination call panels. Owing to the invention the original special drives as well as the display appliances and other such appliances can be utilized during the modernization. Other advantages of the invention are also presented in connection with the different embodiments of the invention above.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
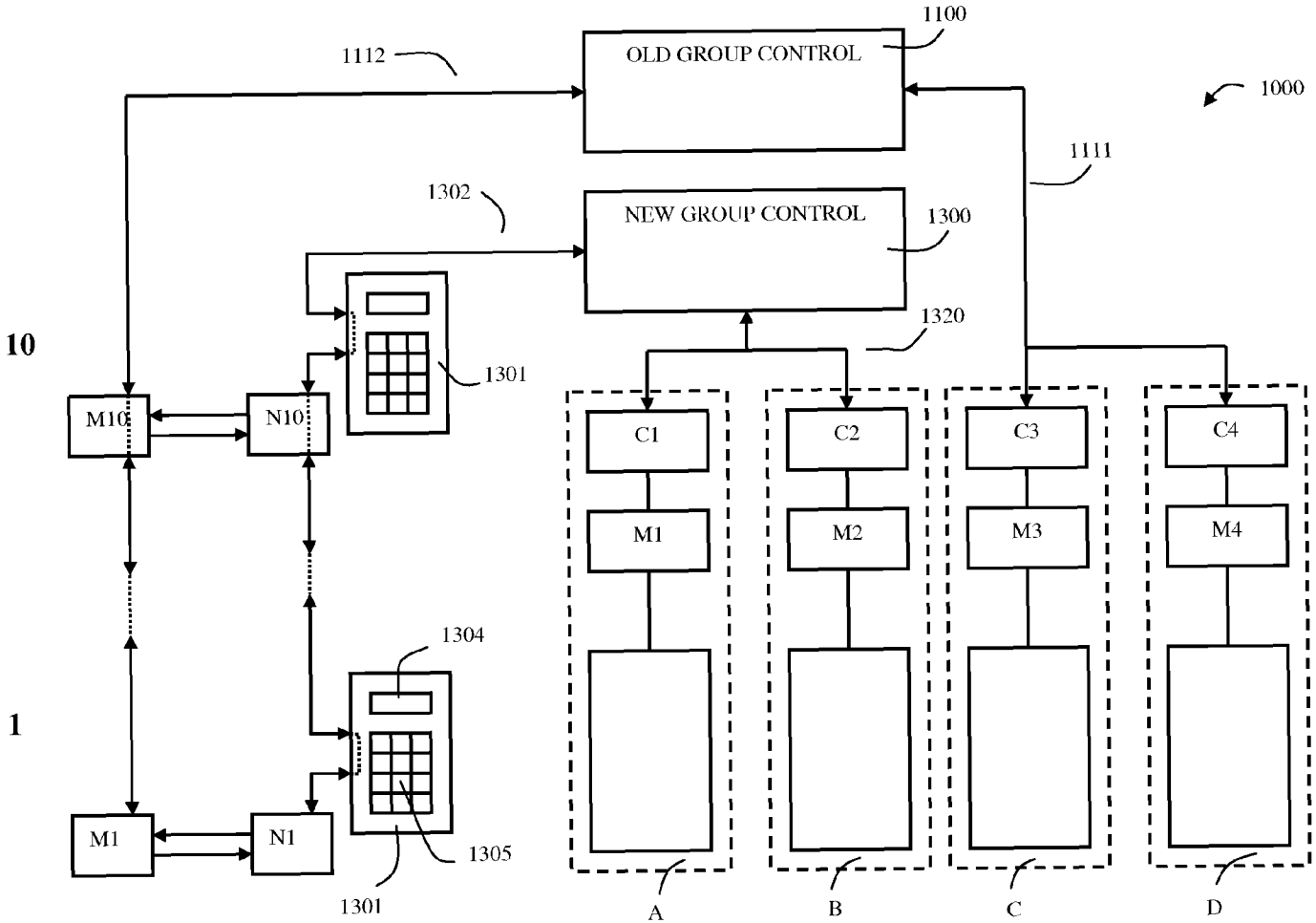
FIG. 1 is a schematic view of an elevator group that is to be modernized, in the modernization of which the solution according to the invention is applied.

FIG. 1 presents an elevator group 1000 that is to be modernized, in the modernization of which the solution according to the invention is applied. The elevator group comprises four elevators (A, B, C, D), which serve floors 1-10 of the building and each of which comprises an elevator car, a hoisting machine (M1, M2, M3, M4) and an elevator control (C1, C2, C3, C4) that controls the elevator. In the case presented in FIG. 1 the modernization has progressed to the stage in which the elevators A and B are already modernized and correspondingly the elevators C and D are still unmodernized elevators. The new elevator controls C1, C2 have been connected via the control bus 1320 to the new group control 1300, which is installed e.g. in the machine room of the elevator group in the initial phase of the modernization. In the initial phase of the modernization also the landing pushbuttons of the old call-giving appliances (not presented in FIG. 1) have been removed from use and replaced with the new call-giving appliances (1301), which are connected to the new group control via the new landing appliance bus 1302. As can be seen in FIG. 1, the original landing appliance bus 1112 with its floor-specific pushbutton connectors M1-M10 has not been removed, but instead has been arranged e.g. in the elevator hoistway such that the connections to the pushbutton connectors required by the modernization can be made as easily as possible. Pushbutton connector refers in this context to the pushbutton interface, to the connection points of which the original call pushbuttons on the floor levels as well as the pushbutton lights in connection with them can be connected. Any display appliances and other such signaling appliances possibly connected to the original landing appliance bus can be either removed or replaced with new signaling appliances connected to the new group control or they can be left in place connected to the old group control.

It must be noted that FIG. 1 does not show the situation in which one of the elevators of the elevator group would be temporarily out of service due to the modernization but which is an inevitable situation as the modernization progresses from one elevator to another. In this case the system is configured so that elevator calls are served only with operational elevators until the elevator being modernized is again in operable condition and can be connected to the new group control.

The main tasks of the new group control are to receive elevator calls given by passengers on the floor levels and to decide whether to serve the call with an unmodernized or with a modernized elevator. If it is decided to serve a call with an unmodernized elevator, the new group control transmits the call as a landing call to the old group control, which allocates to the passenger an unmodernized elevator from the plurality of unmodernized elevators connected to it. If, on the other hand, it is decided to serve the call with a modernized elevator, the new group control allocates to the call the elevator best suited to the situation from the plurality of modernized elevators.

In order to determine the traffic situation prevailing in the elevator system, the new group control comprises a so-called traffic forecaster, which records statistical information about the travel events of the elevator system at different times over the 24-hour period and on weekdays. Information is obtained about travel events on the basis of the calls given by passengers but also the monitoring and statistical recording of different movement detectors, such as the car load weighing signals and/or the car photocell signals, are possible. Utilizing statistical data and the calls given, the traffic forecaster determines the traffic situation prevailing in the elevator system at any given time. It is also possible on the basis of the statistical data to estimate the floor-specific traffic intensities (traffic arriving at and/or leaving the floors) and to utilize the information e.g. in dividing calls between unmodernized and modernized subgroups.

As stated above the original landing call pushbuttons of the elevator group to be modernized are removed from use and replaced with the new call-giving appliances. The call-giving appliances can be any call-giving appliances whatsoever that are suited to the purpose, such as up/down pushbuttons, destination call panels provided with pushbuttons and/or destination call appliances, in which the passenger is identified by means of an electronic identifier and his/her destination floor is determined on the basis of the aforementioned identification. In the case according to FIG. 1 the destination call panels 1301 are installed on the floors, which panels are provided with destination call pushbuttons 1305 and with display means 1304 for notifying the passenger of the elevator or elevators (subgroup) allocated. The solution in question, in which all the call-giving appliances are destination call appliances, is known as a so-called full destination system, in which case car call panels are not necessarily needed in the elevator cars for indicating the destination floor in the elevator car, because the group control has information about the destination floor of the passenger and can thus send the elevator serving the passenger automatically to the destination floor of the passenger. The number and placement of the call-giving appliances on the floors can be freely selected, e.g. an extra destination call panel can be disposed in the entrance lobby for people leaving the entrance, in which case a passenger can indicate his/her destination floor in good time before arriving at the elevators.

The call-giving appliances transmit the call given by the passenger to the new group control via the landing appliance bus 1302. The landing appliance bus 1302 is preferably a field bus based on serial format data transfer, e.g. a CAN bus, but from the standpoint of the invention any bus solution at all that is suited to the purpose and can be connected to the new group control is possible. Other appliances situated on the floor levels can also be connected to the new landing appliance bus if necessary, such as e.g. display appliances and/or signaling appliances (not presented in FIG. 1) connected to the elevator group.

According to the invention a connection is arranged between the new and the old group control for transmitting calls from the new group control to the old group control. In order to implement the connection an adapter unit N (N1-N10) is installed in the landing appliance bus on each floor level, which adapter unit is connected to the pushbutton interface M of the old call-giving appliance on the corresponding floor level, e.g. with a connection according to FIG. 2. By integrating the functionality of the adapter unit N into the new call-giving appliances, the interface can be implemented with connections between the new call-giving appliances and the old call-giving appliances, in which case installation of the adapter units N during the modernization is avoided. By means of the interface described the new group control can simulate the function of the original call pushbuttons and also monitor the on-state of the pushbutton lights in connection with them. When the new group control transmits a call received from a passenger to the old group control, it sends a control sequence to the adapter unit N on the departure floor of the passenger, on the basis of which the adapter unit activates a control pulse that simulates the original call pushbutton. Information about the control pulses (about a simulated landing call) is conveyed via the pushbutton interface M to the old group control, which after receiving the simulated call allocates to the passenger an elevator from the plurality of elevators of the relevant subgroup. At the same juncture, the old group control activates registration of the call and the pushbutton light signal that indicates the on-state of the call in the old call-giving appliance (pushbutton interface) that receives the call until the allocated elevator arrives at the departure floor of the passenger and the pushbutton light signal that indicates the on-state of the call is reset. Information about the on-state of the call (from the pushbutton light signal) is conveyed via the pushbutton interface to the adapter unit N and onwards to the new group control. Information about the on-state of calls transmitted to the old group control is thus obtained for the new group control, on the basis of which the new group control can monitor e.g. the waiting times (call times) connected to calls transmitted to the unmodernized subgroup.

When the passenger arrives at the waiting lobby and gives an elevator call using the call-giving appliance 1301 on the floor, the call data related to the call is conveyed to the new group control. The call data determines the departure floor of the passenger and in addition also the destination floor (target floor) of the passenger, or the direction of travel of the passenger if the call-giving appliance is a landing call appliance. In addition the call data can comprise additional information related to the call given by the passenger, on the basis of which the group control receives information as to whether the passenger is e.g. physically handicapped.

When a new group control has received the call data it divides the calls between the modernized and unmodernized subgroups on the basis of the given selection criterion. Selection criterion in this context refers to classification rules on the basis of which the calls given by a passenger are addressed to unmodernized subgroups or to a modernized subgroup. This means in fact therefore a pre-selection of the subgroup serving a call before the actual allocation of the call in the selected subgroup. In the selection criteria the subgroup serving the call is selected on the basis of one or more classification rules. Classification rules are diverse and they can be selected to be the best suitable for each elevator system to be modernized e.g. on the basis of the assumed and determined traffic flows of the building, on the basis of the extent of modernization or on the basis of some other corresponding criterion. The classification rules can be independent of the elevator system or they can change on the basis of the status of the elevator system, e.g. as the traffic situation prevailing in the elevator system changes, as the number of modernized/unmodernized elevators changes or when detecting an exceptional situation in the elevator system, in other words the system can use the best applicable, dynamically changeable selection criterion for each traffic situation, modernization extent and/or exceptional situation. Classification rules and/or their threshold values can be determined manually and/or automatically e.g. as the number of modernized elevators changes or in connection with some other aforementioned detected change of status in the elevator system. Classification rules can be prioritized such that in conflicting situations where, when different classification rules give a different subgroup as the result, the classification rule of the highest priority determines the subgroup indicated by the selection criterion.

In the following some examples of classification rules are presented, on the basis of which the subgroup serving the call can be selected:

- a subgroup is selected on the basis of average waiting time: The waiting times of passengers are comprehensively monitored (in the whole elevator system) and/or for specific floors and/or in different subgroups and a subgroup is selected on the basis of the determined waiting time. For example, if the average waiting time in the entrance lobby is below a given threshold value (e.g. less than 20 s) the call is addressed to a modernized subgroup, or the average determined waiting times for different subgroups are compared to each other and the call is served with the groups of which the waiting time is the shortest.
- a subgroup is selected on the basis of the floor zones: One or more floor zones are determined from the elevator system as well as the subgroup serving the zone. If a call (departure floor and/or destination floor) given by a passenger targets the aforementioned zone, the call is served with a subgroup according to the determination of the zone. Zones can be determined e.g. on the basis of which floors each elevator or each elevator group to be modernized originally served, e.g. a so-called high-rise zone and low-rise zone.
- a subgroup is selected on the basis of the load factor of the elevators: The number of calls and the number of stops to be served of the elevators of each group are determined, as well as the car load of the modernized elevators and the call is addressed to the least loaded subgroup.
- a subgroup is selected on the basis of the call history: The calls given by passengers and the subgroups selected for the calls are recorded in the memory of the new group control. If the call data of a new call (departure floor and/or destination floor) given by a passenger corresponds to a call that is not yet served and is recorded in the call history, the new call is addressed to the subgroup according to the aforementioned call on the basis of the call history.
- a subgroup is selected on the basis of pre-determined standard floors: One or more floor zones are determined from the elevator system, which is/are served with a certain subgroup. For example, if there are floors in the building to which visitors typically travel, a certain subgroup can be favored in traveling to the floor in question, e.g. a modernized subgroup.

- a subgroup is selected on the basis of a call-specific waiting time. The subgroup with which the estimated waiting time of the passenger in the waiting lobby is minimized is selected as the group serving the call.
- a subgroup is selected on the basis of additional information attached to the call: If additional information is attached to the call given by a passenger, e.g. information about handicapped transport, freight transport or other corresponding special transport, the call can be addressed to a certain subgroup, e.g. physically handicapped people can be served always with modernized elevators.
- a subgroup is selected on the basis of the traffic intensity: If the detected/predicted traffic intensity of a modernized group is e.g. heavy or intensive, calls start to be divided to both modernized and unmodernized subgroups;
- a subgroup is selected on the basis of the traffic type: If the detected/predicted traffic type of a modernized group is e.g. below peak, some of the down calls are addressed to an unmodernized subgroup;
- a subgroup is selected on the basis of the number of modernized and unmodernized elevators: If, for example, one elevator is modernized and five elevators are unmodernized, the elevator calls given are divided between subgroups such that an unmodernized subgroup receives at most 5/6 elevator calls.

If it is decided on the basis of the selection of the subgroup performed that the passenger will be served with unmodernized elevators, the new group control transmits the call to the old group control via the pushbutton interface according to the principles presented above. The old group control receives the call and allocates an unmodernized elevator to the passenger and also activates the pushbutton light signal corresponding to the call as a sign that the call has been received. At the same time the new group control informs the passenger about the serving elevator or elevators on the display of the destination call panel, e.g. with the expression "Move to elevators C, D". When the unmodernized elevator allocated to the call arrives at the departure floor of the passenger, the passenger can move into the elevator serving him/her and indicate his/her destination floor by means of the car call panel in the elevator car. If the call is addressed to a modernized group, the new group control allocates, e.g. using genetic allocation methods, a modernized elevator to the passenger. The optimization criteria of the allocation can be e.g. travel time, waiting time, energy, fill ratio of the car or some combination of these. The optimization criteria can also change according to the traffic situation of the elevator system and/or the modernization extent. The elevator allocated to a passenger is indicated on the display means of the destination call appliance, e.g. with the text "Move to elevator A". When the elevator allocated to the passenger arrives at the departure floor of the passenger, the passenger can move into the elevator car serving him/her. In this case, if the call given by the passenger was a destination call, the elevator drives automatically to the destination floor of the passenger, in other cases the passenger must indicate his/her destination floor by means of the car call panel in the elevator car in order to reach his/her destination.

When the modernization has progressed to the final stage, in which all the elevators to be modernized have been modernized, the adapter units fitted for the purposes of the modernization, the old group control as well as the old landing appliance bus and call-giving appliances can be removed as superfluous.

Figure 2:
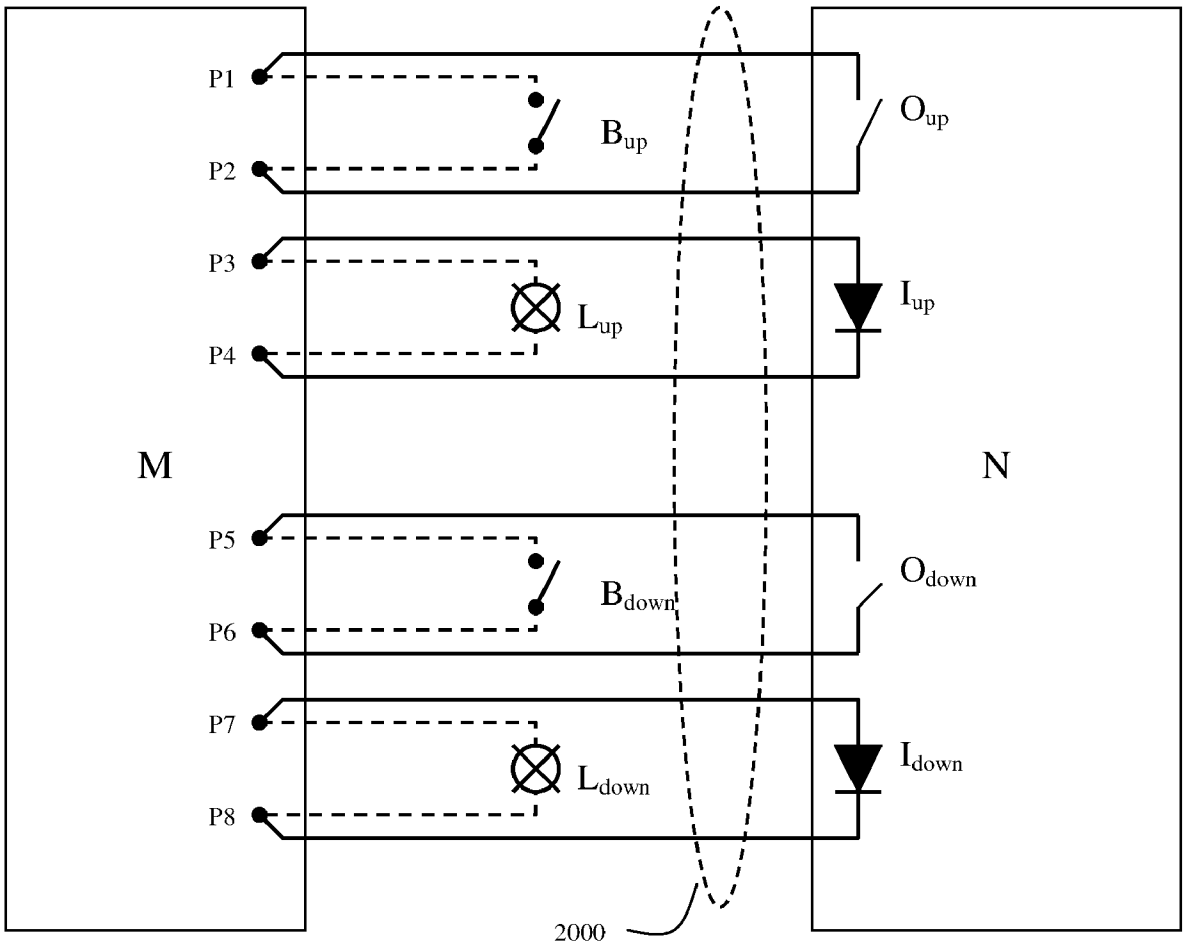
FIG. 2 is a schematic view of one possible way to connect the adapter units to the pushbutton interface of the old call-giving appliances on each floor level.

FIG. 2 presents one possible way to connect the adapter units N to the pushbutton interface of the old call-giving appliances on each floor level. The old call-giving appliances according to the figure comprise a pushbutton interface M as well as the landing call pushbuttons $B_{up}$ and $B_{down}$ (up/down call pushbuttons) that can be connected to it, and also the corresponding pushbutton lights $L_{up}$ and $L_{down}$ that are in connection with the pushbuttons. The adapter unit N is connected with temporary cabling 2000 to the connection points P1-P8 of the pushbutton interface M via the galvanically isolated interface of the pushbutton interface N. The adapter unit can simulate an up call by closing the output $O_{up}$, and detect the on-state of an up call on the basis of the input $I_{up}$. Correspondingly a down call can be simulated by closing the output $O_{down}$ and the on-state of a down call can be detected on the basis of the input $I_{down}$. The connection method according to FIG. 2 can be extended to cases in which the elevator system to be modernized comprises destination call panels on the floor levels.

Figure 3:
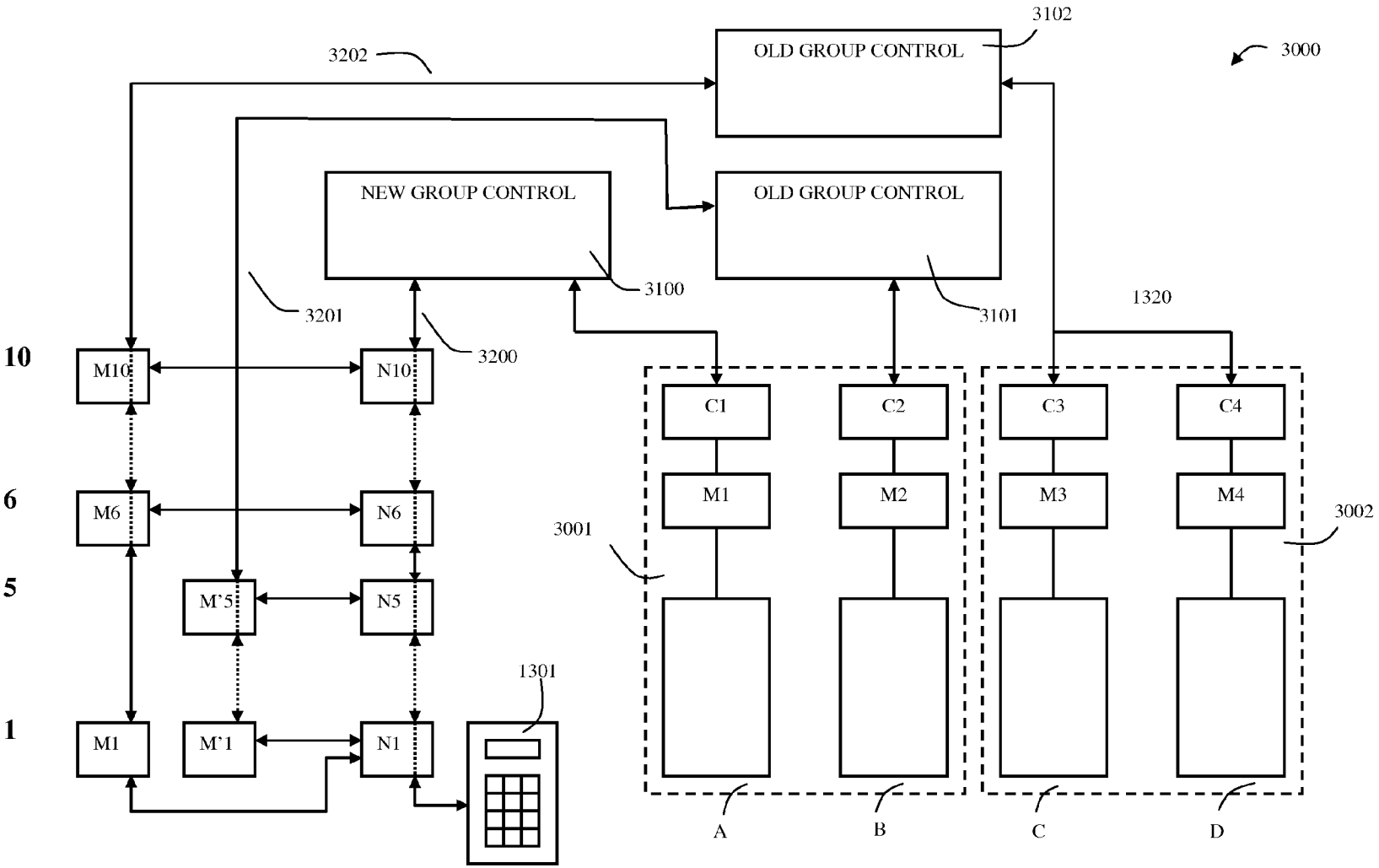
FIG. 3 is a schematic view of an embodiment according to the invention, in which two elevator groups are being modernized into one elevator group.

FIG. 3 presents an embodiment according to the invention, in which two elevator groups are being modernized into one elevator group. The elevator system 3000 to be modernized comprises the elevator groups 3001, 3002, of which the elevator group 3001 serves floors 1-5 (low-rise zone) and the elevator group 3002 serves floors 1, 6-10 (high-rise zone). The original call-giving appliances (not shown in FIG. 3) of the elevator group 3001 are connected via the old landing appliance bus 3201 to the group control 3101 and correspondingly the original call-giving appliances (not shown in FIG. 3) of the elevator group 3002 are connected via the landing appliance bus 3202 to the group control 3002. In the case according to FIG. 3 the elevator A of the elevator group 3001 is a modernized elevator, whereas the elevator B as well as the elevators C, D of the elevator group 3002 are unmodernized elevators In the initial stage of modernization a new group control 3100 as well as a new landing appliance bus 3200 with its call-giving appliances is installed in connection with the elevator system, of which only the destination call appliance 1301 on floor 1 is shown in FIG. 3. The system thus comprises three subgroups, of which the modernized elevator A of the first subgroup is connected to the new group control 3100, the unmodernized elevator B of the second subgroup to the old group control 3101 and the unmodernized elevators C and D of the third subgroup to the old group control 3102. For transmitting calls from the new group control to the old group controls, the new group control is connected to the pushbutton interface M and M' of the old call-giving appliances via the adapters N in the manner presented in FIG. 3. When a passenger gives a destination call in the entrance lobby (on floor 1) the new group control receives the call and decides on the basis of the given selection criterion with which subgroup the call will be served. If the call is addressed to either of the unmodernized subgroups, the new group control transmits the call either to the group control 3101 or to the group control 3102, e.g. on the basis of the destination floor of the passenger, such that if the destination floor is 2-5 the call is transmitted to the group control 3101 via the pushbutton interface M' and correspondingly if the destination floor is 6-10 the call is transmitted to the group control 3102 via the pushbutton interface M. In cases in which the old elevator groups have several shared floors, which are served with both groups, the classification rules presented above can be applied in selecting the subgroup to serve the call.

The invention claimed is:

1. Method for modernizing at least one elevator group, which elevator group comprises a plurality of elevators, a group control that controls the elevator group as well as call-giving appliances connected to the group control via the landing appliance bus, each call-giving appliance comprising one or more call pushbuttons, wherein the method comprises the phases:

a new group control, new call-giving appliances on the floor levels and also a new landing call bus for connecting the aforementioned new call-giving appliances to the new group control are installed;

a new group control is connected to the pushbutton interface of the old call-giving appliances for transmitting calls from the new group control to the old group control;

one or more elevators of the elevator group are modernized;

the elevator calls given by passengers are received from the new call-giving appliances;

the calls given are divided between the modernized subgroup and at least one unmodernized subgroup on the basis of the selection criterion given, and the calls addressed in the new group control to the modernized elevators are allocated to the modernized subgroup;

the calls addressed to the unmodernized subgroup are allocated via the aforementioned pushbutton interface to the group control of the unmodernized group control.

2. Method according to claim 1, wherein the calls given by passengers are transmitted as landing calls to the group control of the unmodernized subgroup.

3. Method according to claim 1, wherein one or more destination call appliances are installed as the call-giving appliance of a floor and landing call appliances are installed on the other floors.

4. Method according to claim 1, wherein the method includes the phases:

the on-state of calls transmitted to the modernized subgroup are monitored on the basis of the pushbutton light signals that are in connection with the aforementioned pushbutton interfaces, a waiting time for the calls transmitted to the unmodernized subgroup is determined on the basis of the aforementioned monitoring.

5. Method according to claim 1, wherein adapter units are installed in the new landing appliance bus for connecting the new group control to the pushbutton interface of the old call -giving appliances on each floor level.

6. Method according to claim 1, wherein the new group control is connected via the new call - giving appliances to the pushbutton interface of the old call-giving appliances on each floor level.

7. Method according to claim 1, wherein one or more classification rules are used as the aforementioned selection criterion/criteria, in which classification rule(s) the calls given are divided between the modernized and the unmodernized subgroups either on the basis of average waiting time; or on the basis of one or more floor zones; or on the basis of the call history; or on the basis of one or more pre-determined standard floors; or on the basis of a call-specific waiting time; or on the basis of the load factor of the elevators; or on the basis of additional information attached to the call; or on the basis of the traffic intensity; or on the basis of the traffic type; or on the basis of the number of modernized and unmodernized elevators.

8. Method according to claim 7, wherein the classification rules and/or the threshold values of the classification rules are selected on the basis of the modernization extent of the elevator group and/or the traffic situation and/or the exceptional situation of the elevator system.

9. Method according to claim 8, wherein the classification rules of the selection criterion and/or the threshold values of the classification rules are changed manually and/or automatically.

10. Method according to claim 1, wherein the method further comprises the phases: statistical data is collected about the travel events of the elevator group; and the collected statistical data is utilized in determining the traffic situation of the elevator group and/or the floor-specific traffic intensities.

11. Method according to claim 1, wherein the new group control is connected to the group control of two or more elevator groups that are to be modernized by connecting the new group control to the pushbutton interface of the call-giving appliances of the elevator groups that are to be modernized for transmitting calls from the new group control to the group controls of the elevator groups that are to be modernized.

12. System for modernizing at least one elevator group, which elevator group comprises a plurality of elevators (A, B, C, D), a group control that controls the elevator group as well as call-giving appliances connected to the group control via the landing appliance bus, each call-giving appliance comprising one or more call pushbuttons, as well as a new group control installed at the beginning of the modernization, a new landing appliance bus with new call-giving appliances and also one or more modernized elevators (A, B), wherein the system is connected to the pushbutton interface (M) for transmitting calls from the new group control to the old group control, and in that the new group control is arranged:

to divide elevator calls given by passengers with the new call-giving appliances between the modernized subgroup and at least one unmodernized subgroup on the basis of the given selection criterion, and to allocate calls addressed to a modernized subgroup to the modernized (A, B) elevators;

to transmit calls addressed to an unmodernized subgroup onwards via the aforementioned pushbutton interface (M) to the group control of the unmodernized subgroup.

13. System according to claim 12, wherein a call transmitted to the group control of an unmodernized subgroup is a landing call.

14. System according to claim 12, wherein a destination call appliance is installed as the call-giving appliance of one or more floors and landing call appliances are installed on the other floors.

15. System according to claim 12, wherein the new group control is arranged:

to monitor the on-state of calls transmitted to the subgroup to be modernized on the basis of the pushbutton light signals that are in connection with the aforementioned pushbutton interfaces, and to determine a waiting time for the calls transmitted to the unmodernized subgroup on the basis of the aforementioned monitoring.

16. System according to claim 12, wherein the system is connected to the pushbutton interface (M) of the old call-giving appliances via the adapter units (N) installed in connection with the new landing appliance bus on each floor level.

17. System according to claim 11, wherein the new group control is connected via the new call-giving appliances to the pushbutton interface (M) of the old call-giving appliances on each floor level.

18. System according to claim 12, wherein the new group control is arranged to use one or more classification rules as the aforementioned selection criterion/criteria, in which classification rule(s) the calls given are divided between the modernized and the unmodernized subgroups either on the basis of average waiting time; or on the basis of one or more floor zones; or on the basis of the call history; or on the basis of one or more pre-determined standard floors; or on the basis of a call-specific waiting time; or on the basis of the load factor of the elevators; or on the basis of additional information attached to the call; or on the basis of the traffic intensity; or on the basis of the traffic type; or on the basis of the number of modernized and unmodernized elevators.

19. System according to claim 18, wherein the system comprises means for changing the classification rules and/or the threshold values of the classification rules manually and/or automatically on the basis of the modernization extent of the elevator group and/or the traffic situation and/or the exceptional situation of the elevator system.

20. System according to claim 12, wherein the system comprises means for collecting statistical data about the travel events of the elevator group and for utilizing the collected statistical data in determining the traffic situation of the elevator group and/or the floor -specific traffic intensities.

21. System according to claim 12, wherein the new group control is connected to the pushbutton interface (M, M') of the call-giving appliances of the two or more groups that are to be modernized for transmitting calls from the new group control to the group controls of the aforementioned groups that are to be modernized.

* * * * *